US012503276B2

(12) United States Patent
Bontrager

(10) Patent No.: US 12,503,276 B2
(45) Date of Patent: Dec. 23, 2025

(54) FOOD CONTAINERS HAVING LOCKING INTERFACES

(71) Applicant: Congruens Group, LLC, San Carlos, CA (US)

(72) Inventor: Rick Bontrager, San Carlos, CA (US)

(73) Assignee: Congruens Group, LLC, San Carlos, CA (US)

( * ) Notice: Subject to any disclaimer, the term of this patent is extended or adjusted under 35 U.S.C. 154(b) by 0 days.

(21) Appl. No.: 17/075,946

(22) Filed: Oct. 21, 2020

(65) Prior Publication Data

US 2021/0114779 A1 Apr. 22, 2021

Related U.S. Application Data

(60) Provisional application No. 62/980,343, filed on Feb. 23, 2020, provisional application No. 62/924,133, filed on Oct. 21, 2019.

(51) Int. Cl.
*B65D 43/16* (2006.01)
*B65D 1/34* (2006.01)

(52) U.S. Cl.
CPC ..... *B65D 43/162* (2013.01); *B65D 1/34* (2013.01); *B65D 2543/00268* (2013.01); *B65D 2543/005* (2013.01)

(58) Field of Classification Search
CPC ..... B65D 43/162; B65D 2543/0062; B65D 43/0204; B65D 43/021; B65D 2543/005; B65D 1/34

(Continued)

(56) References Cited

U.S. PATENT DOCUMENTS 3,851,789 A 12/1974 Case et al.
D524,645 S 7/2006 LaMasney (Continued)

FOREIGN PATENT DOCUMENTS

EP 1500607 A1 1/2005
EP 2147873 A2 1/2010

(Continued)

OTHER PUBLICATIONS

PCT International Search Report and Written Opinion in International Application PCT/US2020/056658, mailed Feb. 23, 2021, 16 pages.

(Continued)

*Primary Examiner* — Robert Poon
(74) *Attorney, Agent, or Firm* — Goodwin Procter LLP

(57) ABSTRACT

A container includes a molded fiber tray at least partially defining a tray internal volume. The tray includes a perimeter wall extending upward from a bottom tray surface, a rest extending outward from the perimeter wall, a parapet extending upward from the rest, and a tray build-up projecting inward from the parapet. The tray build-up and the rest at least partially define a gap therebetween. The container includes a molded fiber lid at least partially defining a lid internal volume. The lid includes a perimeter wall extending downward from a lid upper surface, and a ridge extending downward from the perimeter wall. The ridge includes an outer ridge wall, a lateral surface extending inward from the outer ridge wall, and a lid build-up projecting outward from the outer ridge wall. The lid build-up is configured to be received in the gap when the container is in a closed condition.

16 Claims, 11 Drawing Sheets

(58) Field of Classification Search
USPC ..... 206/557; 220/4.23, 4.22, 4.21, 796
See application file for complete search history.

(56) References Cited

U.S. PATENT DOCUMENTS

| | | | | |
|---|---|---|---|---|
| D536,992 | S | 2/2007 | Garg | |
| 7,287,660 | B2 * | 10/2007 | Ramirez | B65D 1/24 220/4.23 |
| 7,597,206 | B2 | 10/2009 | Atkins | |
| D625,995 | S | 10/2010 | Vovan | |
| D657,237 | S | 4/2012 | Allers | |
| D664,841 | S | 8/2012 | Allers | |
| D668,536 | S | 10/2012 | Sanfilippo | |
| 8,387,821 | B2 * | 3/2013 | Yin | B65D 43/021 220/675 |
| D680,860 | S | 4/2013 | Schulter | |
| D683,623 | S | 6/2013 | Chen | |
| 9,580,219 | B2 | 2/2017 | Cimmerer | |
| D793,811 | S | 8/2017 | Ng | |
| 10,036,126 | B2 | 7/2018 | Chung et al. | |
| D886,595 | S | 6/2020 | Wouters | |
| D900,639 | S | 11/2020 | Huang | |
| D910,436 | S | 2/2021 | Krueger | |
| 2005/0035118 | A1 | 2/2005 | Garg | |
| 2005/0061810 | A1 * | 3/2005 | Nordland | B65D 81/3816 220/4.23 |
| 2006/0081641 | A1 | 4/2006 | Haberger | |
| 2010/0072217 | A1 | 3/2010 | Parikh | |
| 2010/0102074 | A1 | 4/2010 | Parikh | |
| 2012/0031921 | A1 | 2/2012 | Cadiente | |
| 2020/0399017 | A1 | 12/2020 | Mueller | |
| 2020/0399018 | A1 * | 12/2020 | Mueller | B65D 43/162 |

FOREIGN PATENT DOCUMENTS

| | | | |
|---|---|---|---|
| EP | 3502003 | A1 | 6/2019 |
| WO | 2018/212593 | A1 | 11/2018 |
| WO | 2021/045195 | A1 | 3/2021 |

OTHER PUBLICATIONS

U.S. Appl. No. 29/725,182, Office Action mailed Apr. 5, 2021, 6 pages.
U.S. Appl. No. 29/725,183, Notice of Allowance mailed Apr. 8, 2021, 10 pages.
U.S. Appl. No. 29/725,185, Office Action mailed Apr. 5, 2021, 7 pages.
U.S. Appl. No. 29/725,186, Ex-Parte Quayle Action mailed Apr. 5, 2021, 6 pages.
U.S. Appl. No. 29/725,144, Office Action mailed Apr. 5, 2021, 6 pages.
U.S. Appl. No. 29/725,146, Notice of Allowance mailed Apr. 12, 2021, 8 pages.
U.S. Appl. No. 29/725,147, Notice of Allowance mailed Apr. 12, 2021, 8 pages.
U.S. Appl. No. 29/725,148, Notice of Allowance mailed Apr. 12, 2021, 8 pages.

* cited by examiner

FOOD CONTAINERS HAVING LOCKING INTERFACES

CROSS-REFERENCE TO RELATED APPLICATIONS

This application claims priority to and the benefit of U.S. Patent Application Ser. No. 62/980,343, filed Feb. 23, 2020, entitled "Food Container Having Full-Perimeter Locking Interface"; and U.S. Patent Application Ser. No. 62/924,133, filed Oct. 21, 2019, entitled "Food Container Having Moisture Reduction Properties"; the disclosures of which are hereby incorporated by reference herein in their entireties.

INTRODUCTION

Containers for the storage and transport of food include a tray and a lid, which may be separate or interconnected (e.g., clamshell). The tray and/or lid may be made from container materials including one or more of molded fiber or paperboard, plastic, or metal (e.g., aluminum). In some cases, an aluminum container is used in conjunction with a plastic lid, both components may be made of plastic, or molded fiber may be combined with plastics, and so on. Often, such containers merely contain the food for a limited time (sufficient to transport the food from a restaurant to home), but the food therein may become soggy due to excess moisture. This problem is especially apparent in containers that are made from organic (e.g., containing cellulose) materials such as molded fiber. Chemical and/or wax additives added to molded fiber to create the container material may improve the container material resistance to failure or penetration, but may limit the compostability or other desired features. Similarly, molded fiber manufacturing, due to its form (geometry) and aesthetic limitations, has typically been limited to the egg tray and industrial packaging markets. If the moisture in the container is too high, not only will the food get soggy, but the container itself may leak or fail. Leakage may also occur at the interface between the lid and the tray, or the interface may entirely fail if the container is handled roughly during transport. This may lead t a partial or total separation of the tray from the lid and loss or contamination of the food therein.

SUMMARY

In one aspect, the technology relates to a container including: a molded fiber tray at least partially defining a tray internal volume, wherein the molded fiber tray includes a perimeter wall extending upward from a bottom tray surface, a rest extending outward from the perimeter wall, a parapet extending upward from the rest, and a tray build-up projecting inward from the parapet, wherein the tray build-up and the rest at least partially define a gap therebetween; and a molded fiber lid at least partially defining a lid internal volume, wherein the molded fiber lid includes a perimeter wall extending downward from a lid upper surface, and a ridge extending downward from the perimeter wall, wherein the ridge includes an outer ridge wall, a lateral surface extending inward from the outer ridge wall, and a lid build-up projecting outward from the outer ridge wall, wherein the lid build-up is configured to be received in the gap when the container is in a closed condition. In an example, the container further includes a molded fiber hinge integrally formed with both the molded fiber tray and the molded fiber lid. In another example, the tray build-up and the lid build-up are in contact around an entire perimeter of the container. In yet another example, the parapet includes a first thickness and the tray build-up includes a second thickness greater than the first thickness. In still another example, a height of the tray build-up is greater than a thickness of the tray build-up.

In another example of the above aspect, each of the tray build-up and the lid build-up include a leading surface and a holding surface. In an example, the tray build-up further includes a tray build-up terminal surface spanning the tray build-up leading surface and the tray build-up holding surface. In another example, the lid build-up further includes a lid build-up terminal surface spanning the lid build-up leading surface and the lid build-up holding surface. In yet another example, when in the closed condition, the tray build-up terminal surface is in contact with the outer ridge wall and the lid build-up terminal surface is in contact with the parapet. In still another example, each of the tray build-up leading surface and the tray build-up holding surface are disposed at an angle to the parapet.

In another example of the above aspect, when the container is in the closed condition, the rest is in contact with the lateral surface. In an example, each of the tray and the lid include a rim. In another example, when the container is in the closed condition, the tray rim is in contact with the lid rim. In yet another example, the container further includes a molded fiber hinge integral with both the tray rim and the lid rim. In still another example, at least one of the tray and the lid includes an integrally-formed molded fiber tab.

In another example of the above aspect, the bottom tray surface is defined by a plurality of peaks alternating with a plurality of valleys. In an example, the plurality of peaks and the plurality of valleys are surrounded by a perimeter moat.

In another aspect, the technology relates to a container including: a molded fiber tray at least partially defining a tray internal volume, wherein the molded fiber tray includes a perimeter wall extending upward from a tray bottom surface, a rest extending outward from the perimeter wall, a parapet extending upward from the rest, and a tray build-up projecting inward from the parapet, wherein the tray build-up and the rest at least partially define a gap therebetween; a molded fiber lid at least partially defining a lid internal volume, wherein the molded fiber lid includes a perimeter wall extending downward from a lid upper surface, and a rim extending outward from the perimeter wall, wherein the rim is configured to be received in the gap when the container is in a closed condition; and a molded fiber hinge integrally formed with both the molded fiber tray and the molded fiber lid. In an example, the rim terminates at an edge, and wherein the edge presses into the parapet when the container is in the closed condition. In another example, the rim is disposed substantially orthogonal to the parapet when the container is in a closed condition. In yet another example, the lid includes a lateral surface configured to engage the rest when the container is in the closed condition. In still another example, the lateral surface is disposed substantially parallel to the rim.

In another example of the above aspect, the tray bottom surface is defined by a plurality of peaks alternating with a plurality of valleys. In an example, the plurality of peaks and the plurality of valleys are surrounded by a perimeter moat. In another example, the tray includes an upper ramp and wherein the lid includes a lower surface, wherein the upper ramp and lower surface are not in contact when the lid is in the closed condition.

BRIEF DESCRIPTION OF THE DRAWINGS

There are shown in the drawings examples that are presently preferred, it being understood, however, that the invention is not limited to the precise arrangements and configurations shown.

DETAILED DESCRIPTION

Figure 1A:
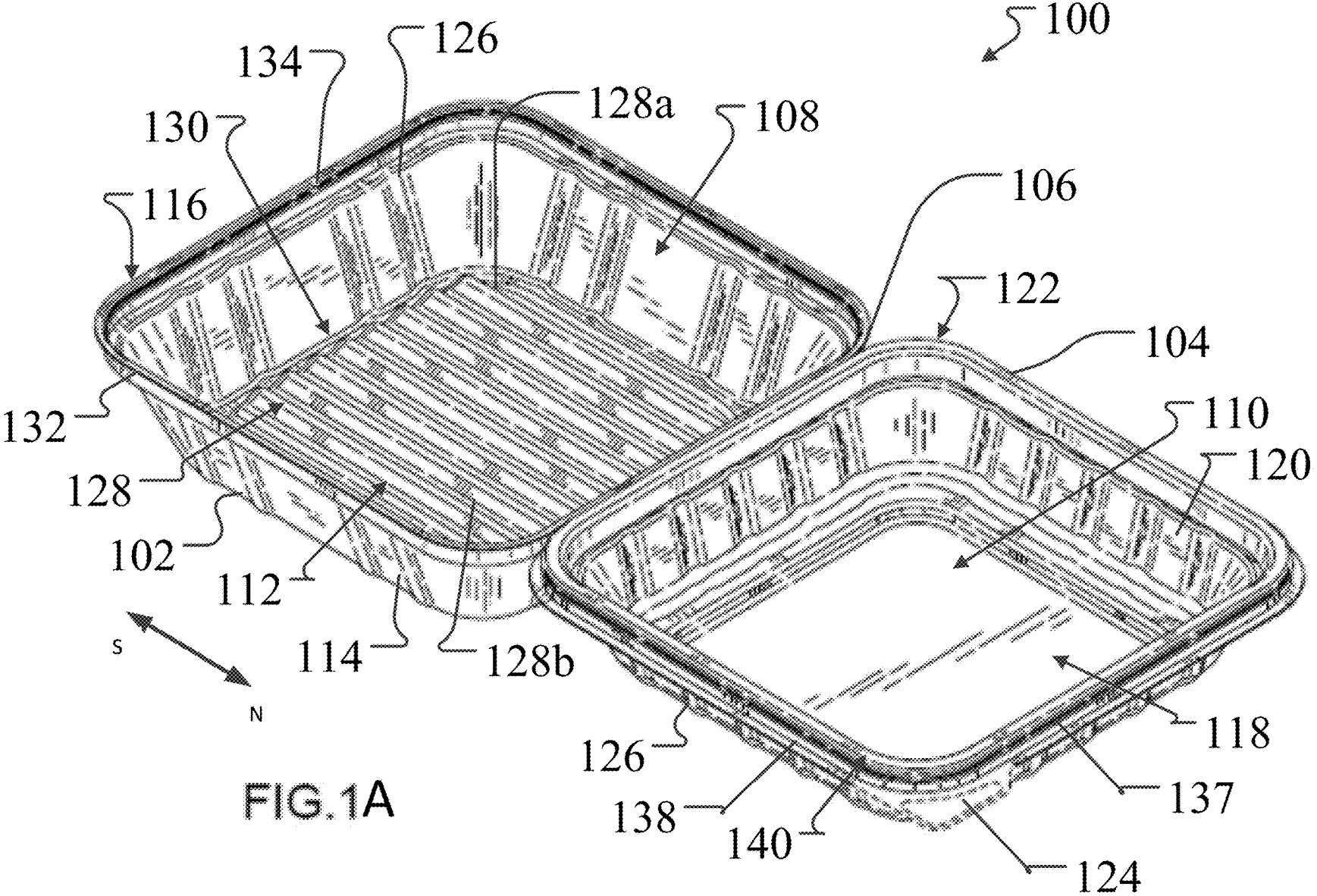
FIG. 1A is a perspective view of a molded fiber container in an open condition.

Containers described herein include a tray portion made of molded fiber and a mating lid portion made of molded fiber. The tray portion may be connected to the lid portion at a foldable hinge, which may be perforated so as to more easily enable separation of the lid and tray, e.g., by tearing or cutting. Specific materials, as well as methods of making such trays and lids, are also described. When closed, the trays and lids described are releasably engaged at an interface, typically around at least a portion of a perimeter of the tray and lid. The interface includes a parapet formed on the tray, as well as a tray build-up disposed on the parapet. Different structures on the lid are described herein that keep the container closed. In one example, a rim of the lid is disposed below the build-up, so as to hold the lid in place. In another example, a ridge may extend from the lid and may include a mating build-up thereon, which may interface with the tray build-up to hold the lid in place. In other examples, an inverted construction is contemplated, where the rim or ridge (and build-up) may be disposed on the tray, while the parapet and a build-up may be disposed on the lid.

In examples where the interface is disposed about only a portion of the container perimeter, the tray may include a ramp or other surface proximate the interface so as to prevent interference between locking portions of the lid and the tray. Regardless of the presence of a pull- or partial-perimeter interface, a bottom of the tray may include a contoured surface such as a repeating ridge or sawtooth pattern. This configuration elevates foodstuffs held within the container above much of the bottom surface, thereby improving airflow and reducing moisture between the food and the container. A perimeter well or moat may be used to capture moisture that may be generated within the closed container. Further, the presence of the well or moat elevates a bottom exterior surface of the tray above a surface upon which the container may be resting (e.g., a counter, table, etc.). This also improves airflow so as to reduce moisture collection (in this case, between the bottom exterior surface and the table). The well or moat may be penetrated by one or more channels that further improve airflow below the bottom exterior surface.

Materials that may be used in the manufacture of the molded fiber tray and lid include those described in U.S. Pat. No. 10,036,126, entitled "Methods for Manufacturing Fiber-Based Beverage Lids," the disclosure of which is hereby incorporated by reference herein in its entirety. These materials include, generally, a mixture of hardwood and softwood fibers, along with trace amounts of other additives, such as a strengthener, grease repellant, and water repellant. Contacting surfaces of the tray and lid may be both smooth, both rough, or one may be smooth and one may be rough. Roughness of the surface may be obtained by incorporating a mesh screen into the mold utilized for formation of the tray and/or lid. Alternatively, a surface may be roughened after manufacture of the tray or lid, for example, by mechanical processes.

Figure 1B:
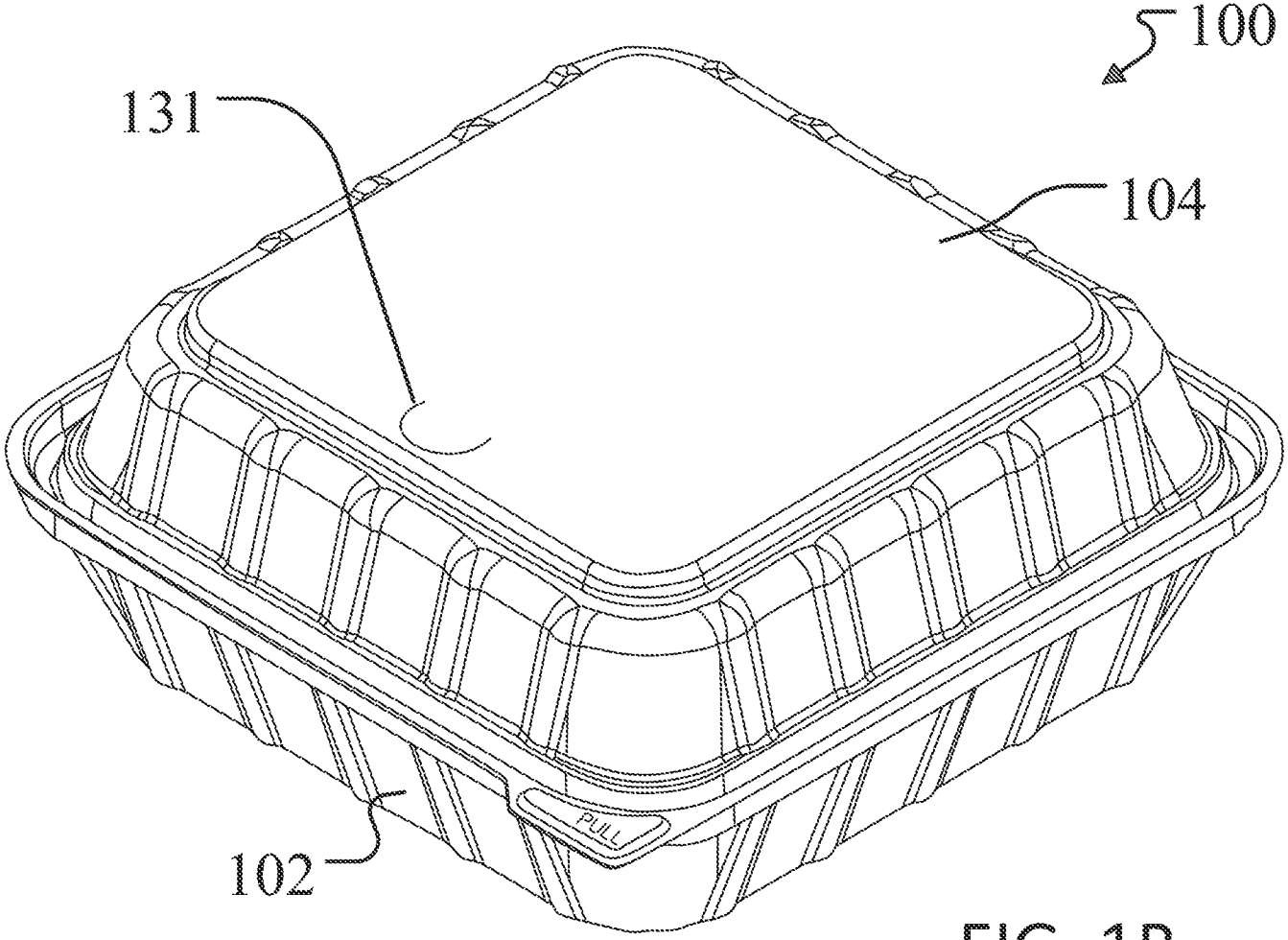
FIG. 1B is a perspective view of the molded fiber container of FIG. 1A in a closed condition.

FIG. 1A is a perspective view of a molded fiber container 100 in an open condition, while FIG. 1B is a perspective view of the molded fiber container 100 in a closed condition. FIGS. 1A and 1B are described concurrently. The container 100 includes a tray portion 102 connected to a lid portion 104 via a foldable or bendable hinge 106. The hinge 106 may extend along the entire width of the tray 102 and lid 104, or only portions thereof (e.g., at the rims thereof, described below). By extending over only a portion of the width, the lid 104 may be more easily disconnected from the tray 102, for example, by tearing or cutting. The container 100 defines an internal volume formed by a tray well 108 and a lid well 110. The tray well 108 is at least partially defined by an interior tray bottom surface 112, a plurality of perimeter walls 114, and an upper rim 116 of the tray 102. Likewise, the lid well 110 is at least partially defined by an interior lid upper surface 118, a plurality of perimeter walls 120, and a lateral surface 122 of the lid 102. A pull tab 124 may be connected to one or both of the tray 102 and lid 104 so as to aid in opening the container 100. Either or both of the perimeter walls 114, 120 may include a number of ribs 126 to increase structural rigidity of the associated perimeter wall 114, 120.

The interior bottom surface 112 of the tray 102 includes a number of features that help reduce moisture build up within the internal volume of the container 100 or at least direct said moisture away from the foodstuff(s) contained therein. A central portion of the bottom surface 112 includes a ridged or sawtooth surface 128 defined by a number of peaks 128*a* separated by a number of valleys or channels 128*b*. This sawtooth surface 128 configuration allows a greater surface area of the food located within the container 100 to be free of contact from the bottom surface 112, which has been determined to reduce moisture buildup therebetween. The channels 128*b* may be flat or may be pitched in one or two directions towards an outer perimeter well or moat 130, which is disposed between the sawtooth surface 128 and any adjacent walls of the perimeter wall 114. In an example, one channel 128*b* may be pitched in a first direction (e.g., north to south, with north being the high point), while an adjacent channel may be pitched in a second direction (e.g., north to south, with south being the high point). (A north-south axis is depicted on FIG. 1A for illustrative purposes). In another example, an approximate midpoint of the channel 128*b* may be the high point. In yet another example, a single end of all channels 128*b* may be the high point, such that liquids may drain in a single direction towards the moat 130. The moat 130 may be disposed below the lowest surface of the lowest channel 128*b* and is configured to capture any moisture that may be generated within the warm environment of the container 100. Thus, condensation, sauces, dressings, or other liquids present in the foodstuff (or generated as the result of temperature) may be guided away from the food, via the channels 128*b*, and captured in the moat 130. In another example, the peaks 128*a* may be elevated at ends thereof (e.g., adjacent the moats 130), which can help keep the food contained therein centered between the perimeter walls 114. This prevents further contact between the food and the walls 114, as well as prevents the food from contacting the moat 130 and the moisture or liquids captured therein. Condensation may be further controlled by incorporating a vent 131, for example, in an upper surface of the lid 104. In the depicted example, the vent 131 includes a curved slit or cut in the material of the lid 104 that may be pressed inward or pulled outward so as to allow heat and/or moisture to escape the internal volume of the closed container 100. The vent 131, while not required, may be desirable since the depicted container includes a locking interface that extends around the full perimeter of the container 100. This full-perimeter locking interface may entirely seal the container 100 when in the closed condition, thereby necessitating a steam, pressure, and/or heat vent 131, as depicted. Containers used for cold- or room-temperature food are examples that may not require a vent, although other factors may be considered.

The container 100 includes a locking interface having components thereof on the tray 102 and lid 104. These components are most easily viewed in FIG. 1A and are described in more detail with regard to FIGS. 3A-3C. In examples, the corresponding locking components are disposed proximate an end of the perimeter walls 114, 120 that defines the limit of the tray well 108 and the lid well 110. The locking component on the tray 102 includes a substantially vertical parapet 132 disposed proximate an upper portion of a portion of the perimeter wall 114. In examples, the parapet 132 is disposed along the entire length of the perimeter wall 114. Further, the parapet 132 extends around the curved corners that connect the various discrete sides of the perimeter wall 114. A tray build-up 134 extends inward from the parapet 132. A corresponding lid build-up 137 extends outward from an outer ridge wall 138 of a ridge 140 disposed on the lid. These features, as well as the spatial relationships therebetween when the container 100 is in the closed condition, are described in more detail with regard to FIGS. 3A-3C, below.

Figure 2:
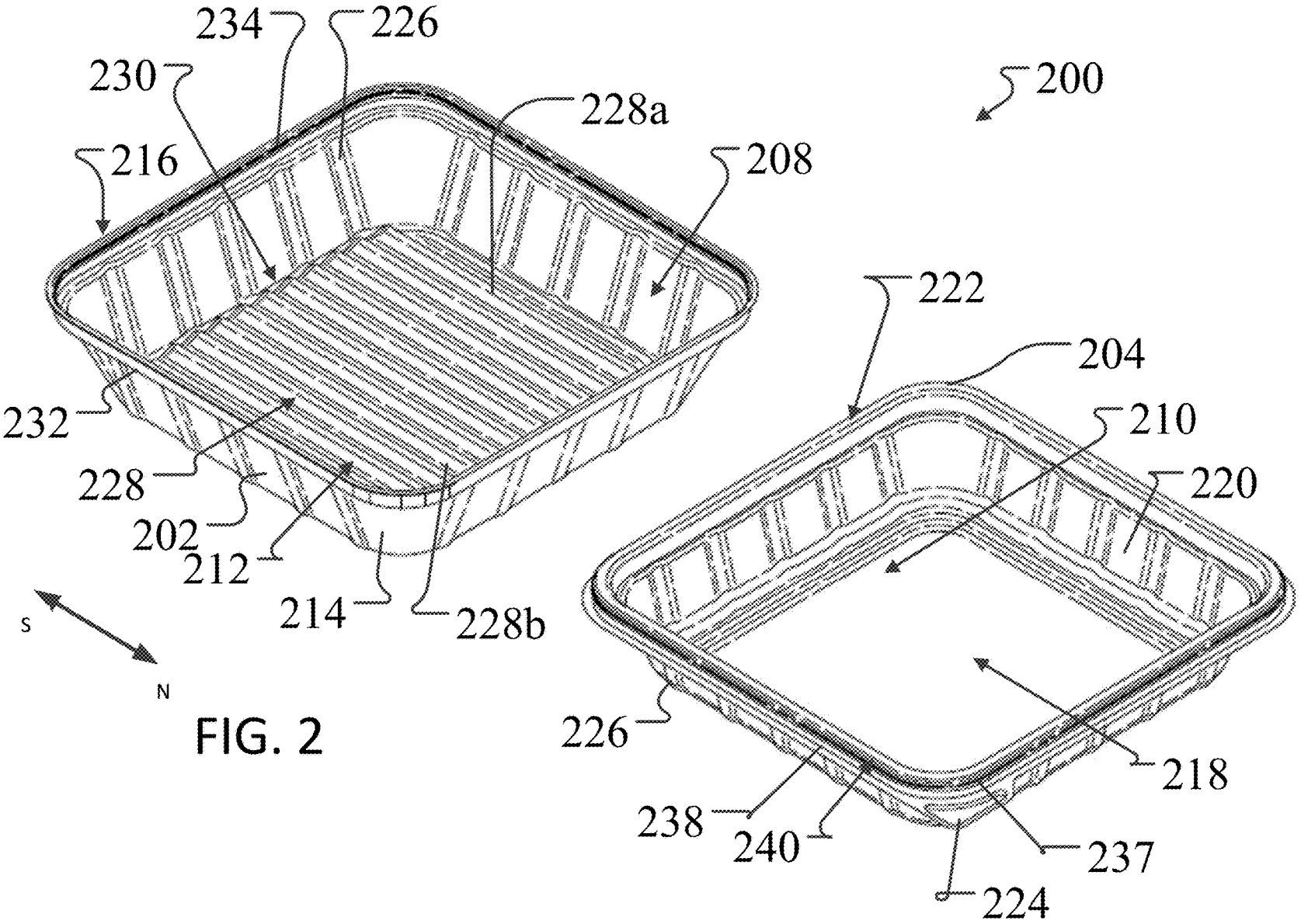
FIG. 2 is a perspective view of another example of a molded fiber container in an open condition.

FIG. 2 is a perspective view of another example of a molded fiber container 200 in an open condition. The container 100 includes a tray portion 202 and a separate, discrete lid portion 204. In that regard, the container 200 is essentially identical in most relevant aspects to the container 200 depicted in FIGS. 1A and 1B, but the tray 202 and the lid 204 are not connected by any hinge. As such, numbering of components in FIG. 2 is similar to that in FIGS. 1A and 1B, with the numbers beginning with 200 instead of 100. The container 200 defines an internal volume formed by a tray well 208 and a lid well 210. The tray well 208 is at least partially defined by an interior tray bottom surface 212, a plurality of perimeter walls 214, and an upper rim 216 of the tray 202. Likewise, the lid well 210 is at least partially defined by an interior lid upper surface 218, a plurality of perimeter walls 220, and a lateral surface 222 of the lid 202. A pull tab 224 may be connected to one or both of the tray 202 and lid 204 so as to aid in opening the container 200. Either or both of the perimeter walls 214, 220 may include a number of ribs 226 to increase structural rigidity of the associated perimeter wall 214, 220.

The interior bottom surface 212 of the tray 202 includes a number of features that help reduce moisture build up within the internal volume of the container 200 or at least direct said moisture away from the foodstuff(s) contained therein. A central portion of the bottom surface 212 includes a ridged or sawtooth surface 228 defined by a number of peaks 228*a* separated by a number of valleys or channels 228*b*. This sawtooth surface 228 configuration allows a greater surface area of the food located within the container 200 to be free of contact from the bottom surface 212, which has been determined to reduce moisture buildup therebetween. The channels 228*b* may be flat or may be pitched in one or two directions towards an outer perimeter well or moat 230, which is disposed between the sawtooth surface 228 and any adjacent walls of the perimeter wall 214. In an example, one channel 228*b* may be pitched in a first direction (e.g., north to south, with north being the high point), while an adjacent channel may be pitched in a second direction (e.g., north to south, with south being the high point). (A north-south axis is depicted on FIG. 2 for illustrative purposes). In another example, an approximate midpoint of the channel 228*b* may be the high point. In yet another example, a single end of all channels 228*b* may be the high point, such that liquids may drain in a single direction towards the moat 230. The moat 230 may be disposed below the lowest surface of the lowest channel 228*b* and is configured to capture any moisture that may be generated within the warm environment of the container 200. Thus, condensation, sauces, dressings, or other liquids present in the foodstuff (or generated as the result of temperature) may be guided away from the food, via the channels 228*b*, and captured in the moat 230. In another example, the peaks 228*a* may be elevated at ends thereof (e.g., adjacent the moats 230), which can help keep the food contained therein centered between the perimeter walls 214. This prevents further contact between the food and the walls 214, as well as prevents the food from contacting the moat 230 and the moisture captured therein. Although not depicted, a vent such as depicted in the container of FIG. 1B may be utilized.

The container 200 includes a locking interface having components thereof on the tray 202 and lid 204. These components are most easily viewed in FIG. 2 and are described in more detail with regard to FIGS. 3A-3C, however, using numbering consistent with those utilized in FIGS. 1A and 1B. In examples, the corresponding locking components are disposed proximate an end of the perimeter walls 214, 220 that defines the limit of the tray well 208 and the lid well 210. The locking component on the tray 202 includes a substantially vertical parapet 232 disposed proximate an upper portion of a portion of the perimeter wall 214. In examples, the parapet 232 is disposed along the entire length of the perimeter wall 214. Further, the parapet 232 extends around the curved corners that connect the various discrete sides of the perimeter wall 214. A tray build-up 234 extends from the parapet 232. A corresponding lid build-up 236 extends from an outer ridge surface 238 of a ridge 240 disposed on the lid. These features, as well as the spatial relationships therebetween when the container 200 is in the closed configuration, are described in more detail with regard to FIGS. 3A-3C, below.

Figure 3A:
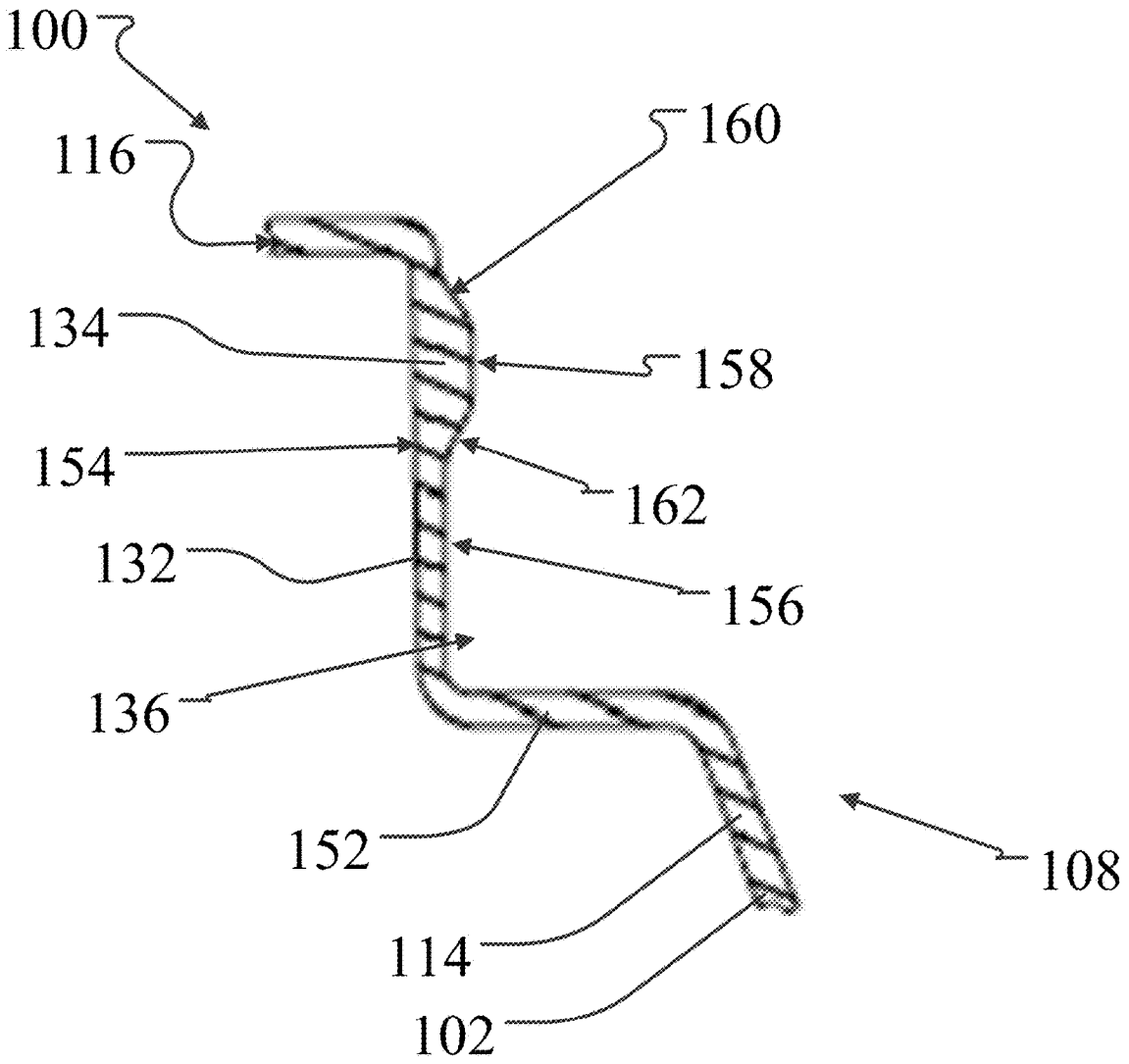
FIGS. 3A-3C are partial section views of a molded fiber container.
Figure 3B:
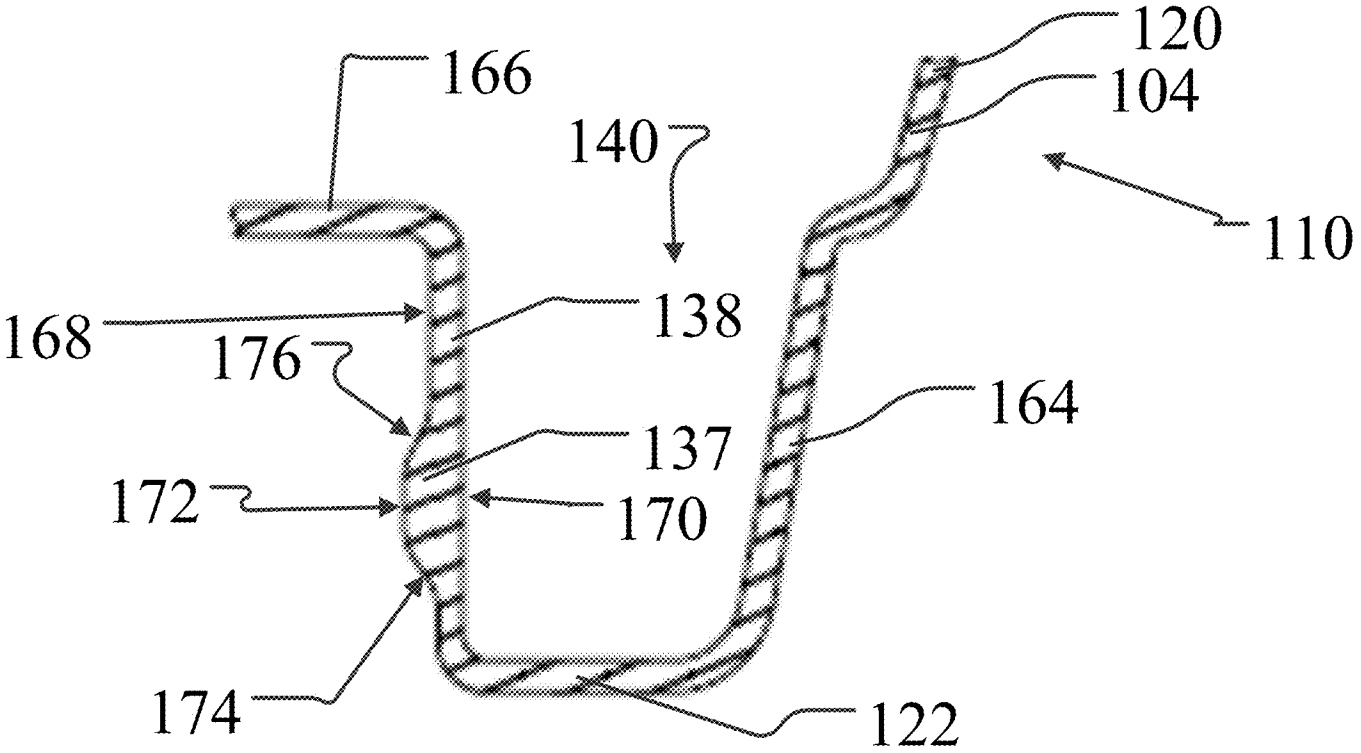
Figure 3C:
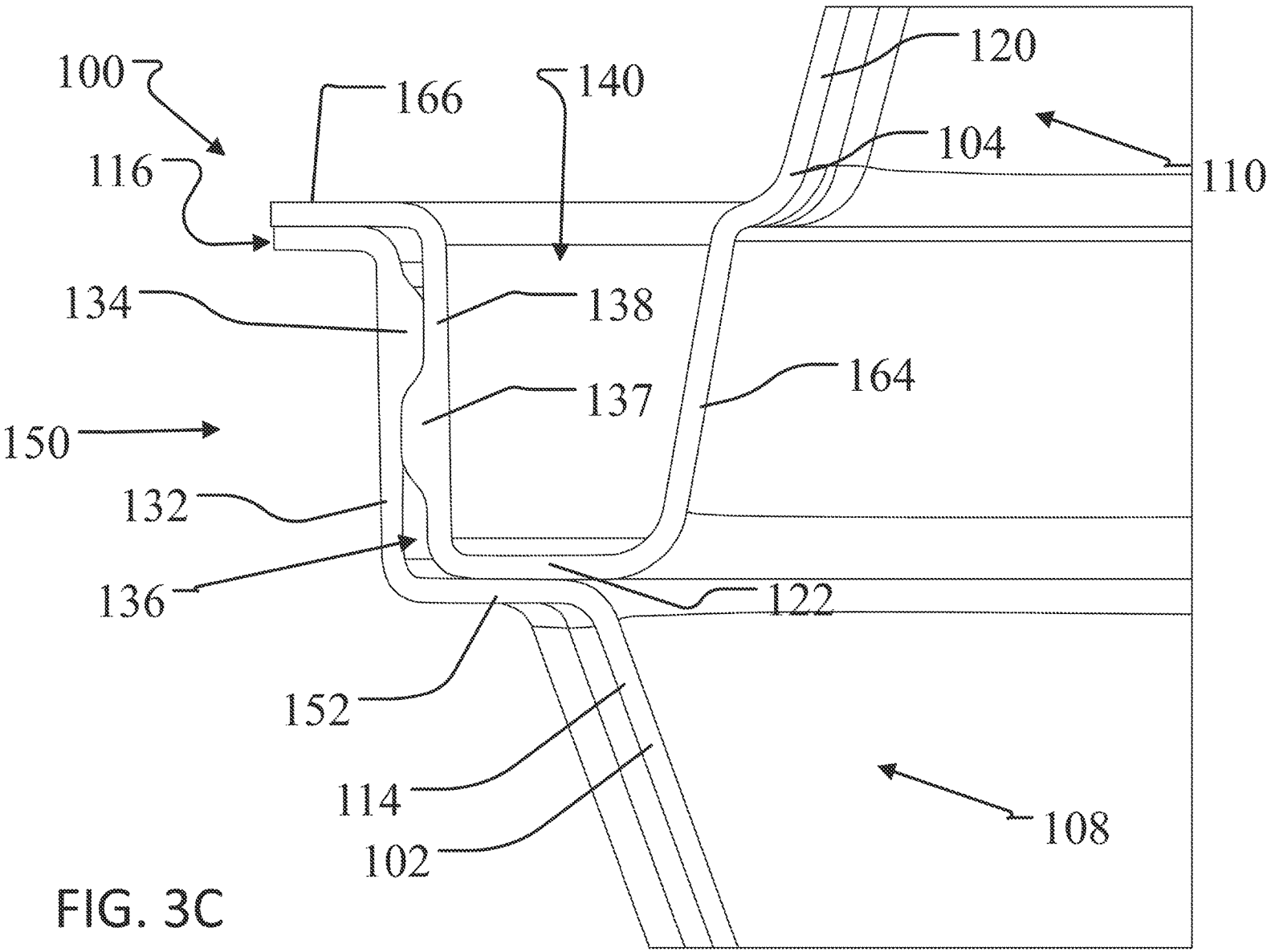

FIGS. 3A-3C are partial section views of a molded fiber container 100. More specifically, FIG. 3A depicts a partial section view of a molded fiber try 102, FIG. 3B depicts a partial section view of a molded fiber lid 104, and FIG. 3C depicts a partial section view of a molded fiber container 100, with the tray 102 and the lid 104 joined at an interface 150. Although numbering beginning with 100 are used in FIGS. 3A-3C, it will be apparent to a person of skill in the art that an identical locking interface 150 may be utilized in conjunction with the container 200 of FIG. 2. FIGS. 3A-3C are described concurrently, but not every component is labeled in every figure, for clarity. The locking interface 150 may extend around a full perimeter of the container 100 so as to create a complete seal. In other examples, components of the locking interface may be present on only certain locations along the perimeter. In one example, components of the locking interface may be present only on straight sides of the container 100 and absent from the curved corners. This may enable easier securement of the lid 104 to the tray 102. In another example, interface 150 components may be absent only from the corner proximate the tab 124, which may aid in initial separation of the lid 104 from the tray 102.

The tray 102 includes a perimeter wall 114. A rest 152 extends outward (relative to the tray well 108 of the tray 102) from the perimeter wall 114. The parapet 132 of the tray 102 extends substantially vertically and includes a tray build-up 134 extending away from the parapet 132 so as to define a gap 136 between a lowermost portion of the build-up 134 and the rest 152. The upper rim 116 defines an upper-most extent of the tray 102. The parapet 132 includes an outer surface 154 and an inner surface 156. The thickness of the parapet 132 between these two surfaces 154, 156 is described elsewhere herein. The tray build-up is defined at least in part by a terminal surface 158, which defines the furthest reach of the tray build-up 134 from the parapet 132. The tray build-up 134 is further defined by a leading surface 160, generally corresponding to an uppermost extent of the tray build-up 134, as well as a holding surface 162, generally corresponding to a lowermost extent of the tray build-up 134. The leading surface 160 and the holding surface 162 are generally angled relative to the inner surface 156 and the build-up terminal surface 158. This angled configuration aids in both engagement and disengagement of the tray 102 and the lid 104, as described in more detail below.

As used herein, the term "build-up" contemplates a structure extending from an adjacent wall, in this case, the parapet 132. A thickness of the parapet 132 and the build-up 134 at the build-up 134 is greater than a thickness of the parapet 132 away from the build-up 134 (e.g., between the outer surface 154 and the inner surface 156, which corresponds to a nominal thickness of the parapet 132 alone). Further, a height of the tray build-up 134 (e.g., as measured at an orientation substantially parallel to the terminal surface 158) may be greater than the thickness of the parapet 132 and the tray build-up 134, combined, e.g., at the build-up 134. In an example, the height of the tray build-up 134 may be measured from the intersection between the inner surface 156 and the leading surface 160 to the intersection of the inner surface 156 and the holding surface 162.

The lid 104 includes a perimeter wall 120. A ridge 140 extends upward from the perimeter wall 120. More specifically, the ridge 140 includes an inner ridge wall 164 that extends from the perimeter wall 120, though in certain examples, the inner ridge wall 164 may correspond to the perimeter wall 120 of the lid 104. The lateral surface 122 extends outward (relative to the lid well 110 of the lid 104) from the inner ridge wall 164. The outer ridge wall 138 extends substantially vertically and includes a lid build-up 137 extending away from the outer ridge wall 138. The lateral surface 122 defines a lower-most extent of the lid 104. An outermost extent of the lid 104 is defined by a rim 166. The outer ridge wall 138 includes an outer surface 168 and an inner surface 170. The thickness of the outer ridge wall 138 between these two surfaces 168, 170 is described elsewhere herein. The lid build-up 137 is defined at least in part by a terminal surface 172, which defines the furthest reach of the lid build-up 137 from the outer ridge wall 138. The lid build-up 137 is further defined by a leading surface 174, generally corresponding to a lowermost extent of the lid build-up 137, as well as a holding surface 176, generally corresponding to an uppermost extent of the lid build-up 137. The leading surface 174 and the holding surface 176 are generally angled relative to the inner surface 168 and the build-up terminal surface 172. This angled configuration aids in both engagement and disengagement of the tray 102 and the lid 104, as described in more detail below.

As used herein and consistent with the description of the tray build-up 134, the term "build-up" contemplates a structure extending from an adjacent wall, in this case, the outer ridge wall 138. A thickness of the outer ridge wall 138 and the build-up 137 at the build-up 137 is greater than a thickness of the outer ridge wall 138 away from the build-up 137 (e.g., between the outer surface 168 and the inner surface 170, which corresponds to a nominal thickness of the outer ridge wall 138 alone). Further, a height of the lid build-up 137 (e.g., as measured at an orientation substantially parallel to the terminal surface 172) may be greater than the thickness of the outer ridge wall 138 and the lid build-up 137, combined, e.g., at the lid build-up 137. In an example, the height of the lid build-up 137 may be measured from the intersection between the outer surface 168 and the leading surface 174 to the intersection of the outer surface 168 and the holding surface 176.

Each of the tray build-up 134 and the lid build-up 137 include both leading surfaces 160, 174, respectively, and holding surfaces 162, 176, respectively. The angles of these various surfaces (e.g., relative to the terminal surfaces 158, 172) may be as required or desired for a particular application. For the leading surfaces 160, 174, very gradual slopes may be advantageous in enabling ease of securing the lid 104 to the tray 102. For example, angles relative to the respective terminal surface 156, 172 of about 5 degrees, about 10 degrees, about 15 degrees, about 20 degrees, about 30 degrees, about 40 degrees, or about 45 degrees may be beneficial to ease securement, with more gradual slopes making securement easier. Steeper slopes may be more advantageous for the holding surfaces 162, 176, for increasing holding force once securement is achieved. However, slopes that are too steep may make disconnection of the lid 104 from the tray 102 too difficult. In that regard, angles relative to the respective terminal surface 156, 172 of about 5 degrees, about 10 degrees, about 15 degrees, about 20 degrees, about 30 degrees, about 40 degrees, or about 45 degrees may be beneficial. Surface texturing of the various surfaces may further affect the forces associated with connecting, holding, or disconnecting the lid 104 and the tray 102.

When the container 100 is in the closed position depicted in FIG. 3C, the rim 166 of the lid 104 is in substantial contact with the upper rim 116 of the tray 102. The lid build-up 137 is received within the gap 136, below the level of the tray build-up 134, so as to retain the lid build-up 137 in place. The holding surface 162 of the tray build-up 134 is in mating contact with the holding surface 176 of the lid build-up 137. Since the lid build-up terminal surface 172 is disposed so as to be in contact with the parapet 132, depending on the tolerances and dimensions of the various components of the tray 102 and the lid 104, the lid build-up terminal surface 172 may press outward against the parapet 132. In such a case, given the relative dimensions of the lid 104 and the tray 102 in this section, a pushing force from the lid 104 is resisted by an opposite pushing force from the tray 102 (e.g., at the parapet 132). These opposed pushing forces help retain the lid build-up 137 within the gap 136 and help prevent the lid build-up 137 from moving upwards against the tray build-up 134. The terminal surface 158 of the tray build-up 134 is in contact with the outer ridge wall 138. Further, the rest 152 is in mating contact with the lateral surface 122 of the lid 104. This contact between the various walls and surfaces that form the interface 150, e.g., between 116 and 166, between 158 and 138, between 162 and 176, between 132 and 172, and between 152 and 122 helps form a seal, which may reduce or eliminate leakage of liquids out of the sealed container 100. When in the closed condition, the interface 150 may form a seal along the entire perimeter of the lid 104 and tray 102.

Figure 4A:
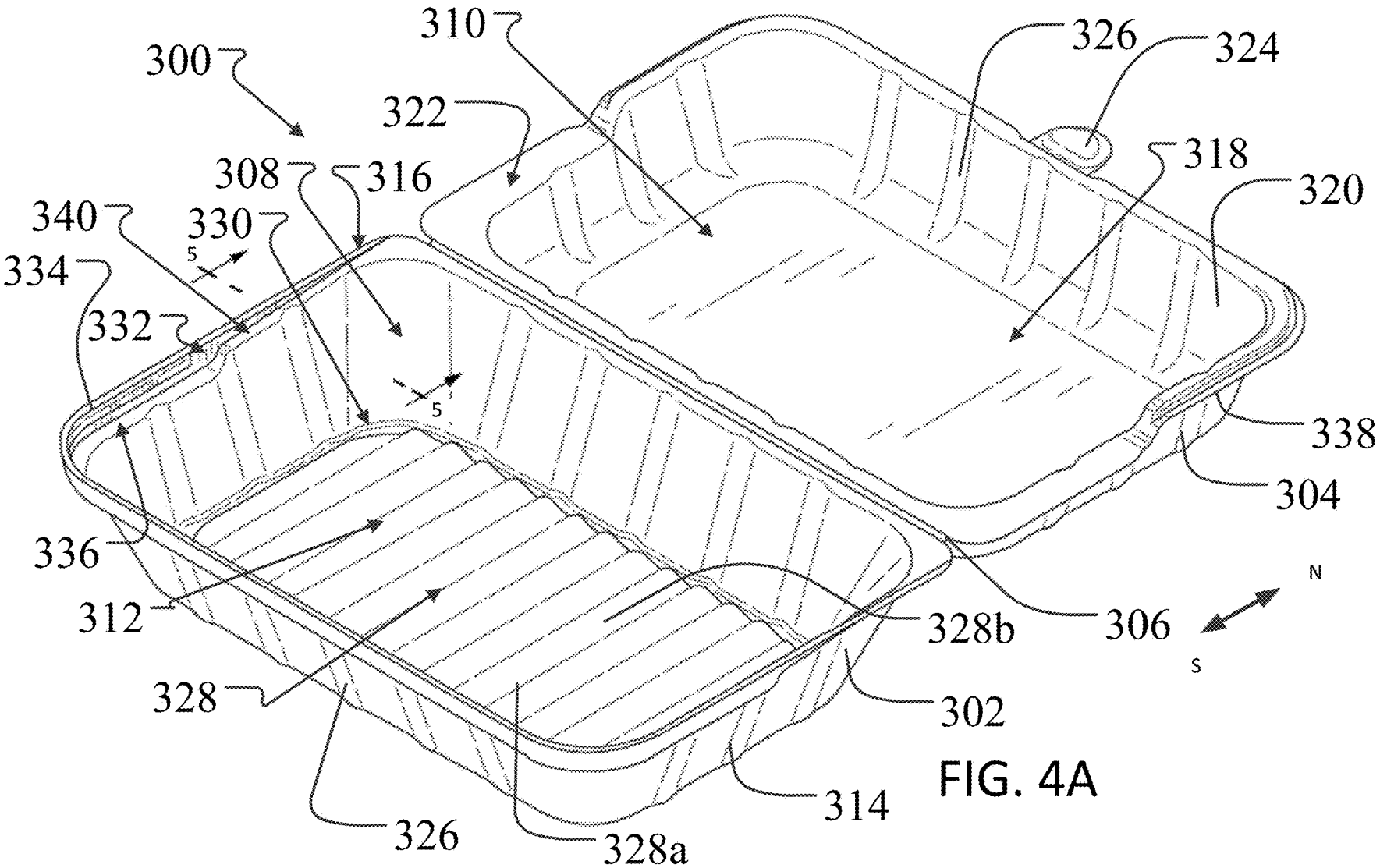
FIG. 4A is a perspective view of another example of a molded fiber container in an open condition.

FIG. 4A is a perspective view of another example of a molded fiber container 300 in an open condition. The container 300 includes a tray portion 302 connected to a lid portion 304 via a foldable or bendable hinge 306. The hinge 306 may extend along the entire width of the tray 302 and lid 304, or only portions thereof, typically connecting the rims thereof (described in more detail below). By extending over only a portion of the width, the lid 304 may be more easily disconnected from the tray 302, for example, by tearing or cutting. The container 300 defines an internal volume formed by a tray well 308 and a lid well 310. The tray well 308 is at least partially defined by an interior bottom surface 312, a plurality of perimeter walls 314, and an upper rim 316 of the tray 302. Likewise, the lid well 310 is at least partially defined by an interior upper surface 318, a plurality of perimeter walls 320, and a lower rim 322 of the lid 302. A pull tab 324 may be connected to one or both of the tray 302 and lid 304 so as to aid in opening the container 300. Either or both of the perimeter walls 314, 320 may include a number of ribs 326 to increase structural rigidity of the associated perimeter wall 314, 320.

The interior bottom surface 312 of the tray 302 includes a number of features that help reduce moisture build up within the internal volume of the container 300 or at least direct said moisture away from the food contained therein. A central portion of the bottom surface 312 includes a ridged or sawtooth surface 328 defined by a number of peaks 328*a* separated by a number of valleys or channels 328*b*. This sawtooth surface 328 configuration allows a greater surface area of the food located within the container 300 to be free of contact from the bottom surface 312, which has been determined to reduce moisture buildup therebetween. The channels 328*b* may be flat or pitched in one or two directions towards an outer perimeter well or moat 330, which is disposed between the sawtooth surface 328 and any adjacent walls of the perimeter wall 314. In an example, one channel 328*b* may be pitched in a first direction (e.g., north to south, with north being the high point), while an adjacent channel may be pitched in a second direction (e.g., north to south, with south being the high point). (A north-south axis is depicted on FIG. 4A for illustrative purposes). In another example, an approximate midpoint of the channel 328*b* may be the high point. In yet another example, a single end of all channels 328*b* may be the high point, such that liquids may drain in a single direction towards the moat. The moat 330 may be disposed below the lowest surface of the lowest channel 328*b* and is configured to capture any moisture that may be generated within the warm environment of the container. Thus, condensation, sauces, dressings, or other liquids present in the foodstuff (or generated as the result of temperature) may be guided away from the food, via the channels 328*b*, and captured in the moat 330. In another example, the peaks 328*a* may be elevated at ends thereof (e.g., adjacent the moats 330), which can help keep the food contained therein centered between the perimeter walls 314. This prevents further contact between the food and the walls 314, as well as prevents the food from contacting the moat 330 and moisture captured therein. Although not depicted, a vent such as depicted in the container of FIG. 1B may be utilized.

The container 300 includes a locking interface having components thereof on the tray 302 and lid 304. In examples, the corresponding locking components are disposed proximate an end of the perimeter walls 314, 320 that defines the limit of the tray well 308 and the lid well 310. The locking component on the tray 302 includes a substantially vertical parapet 332 disposed proximate an upper portion of a portion of the perimeter wall 314. In examples, the parapet 332 is disposed along the entire length of the perimeter wall 314 that is opposite the hinge 306 (referred to herein as a front wall). Further, the parapet 330 extends around the curved corners that connect the front wall to the adjacent side walls, and along a portion of the side walls. A build-up 334 extends from the parapet 332 and forms a gap 336 between the bottom of the build-up 334 and an uppermost portion of the perimeter wall 314. The gap 336 is configured to receive a rim 338 that extends from the perimeter wall 320 of the lid 304. Further, a ramp 340 extends between the parapet 332 and the hinge 306 at an angle that reduces or eliminates contact or interference with the lower rim 322 of the lid 304, as the lid 304 is closed and the rim 338 pushed into the gap 336.

Figure 4B:
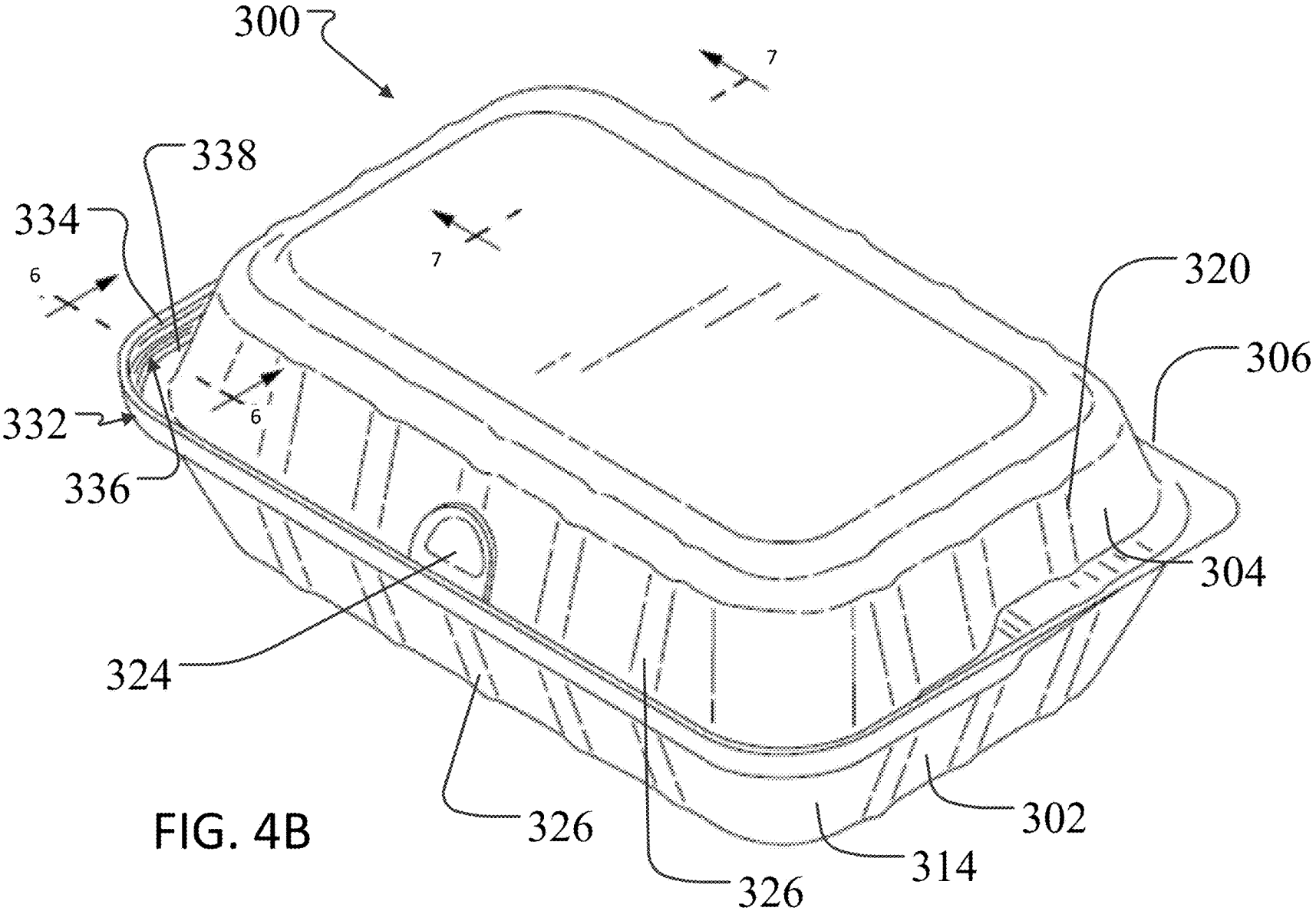
FIG. 4B is a perspective view of the molded fiber container of FIG. 4A in a closed condition.

FIG. 4B is a perspective view of the molded fiber container 300 of FIG. 4A in a closed condition. A number of features depicted in FIG. 4B are described in the context of FIG. 4A and, as such, are not necessarily described further. Notably, the rim 338 is disposed within the gap 336 at least partially defined by the parapet 332 and the build-up 336. This helps hold the container 300 in the closed condition depicted.

Figure 5:
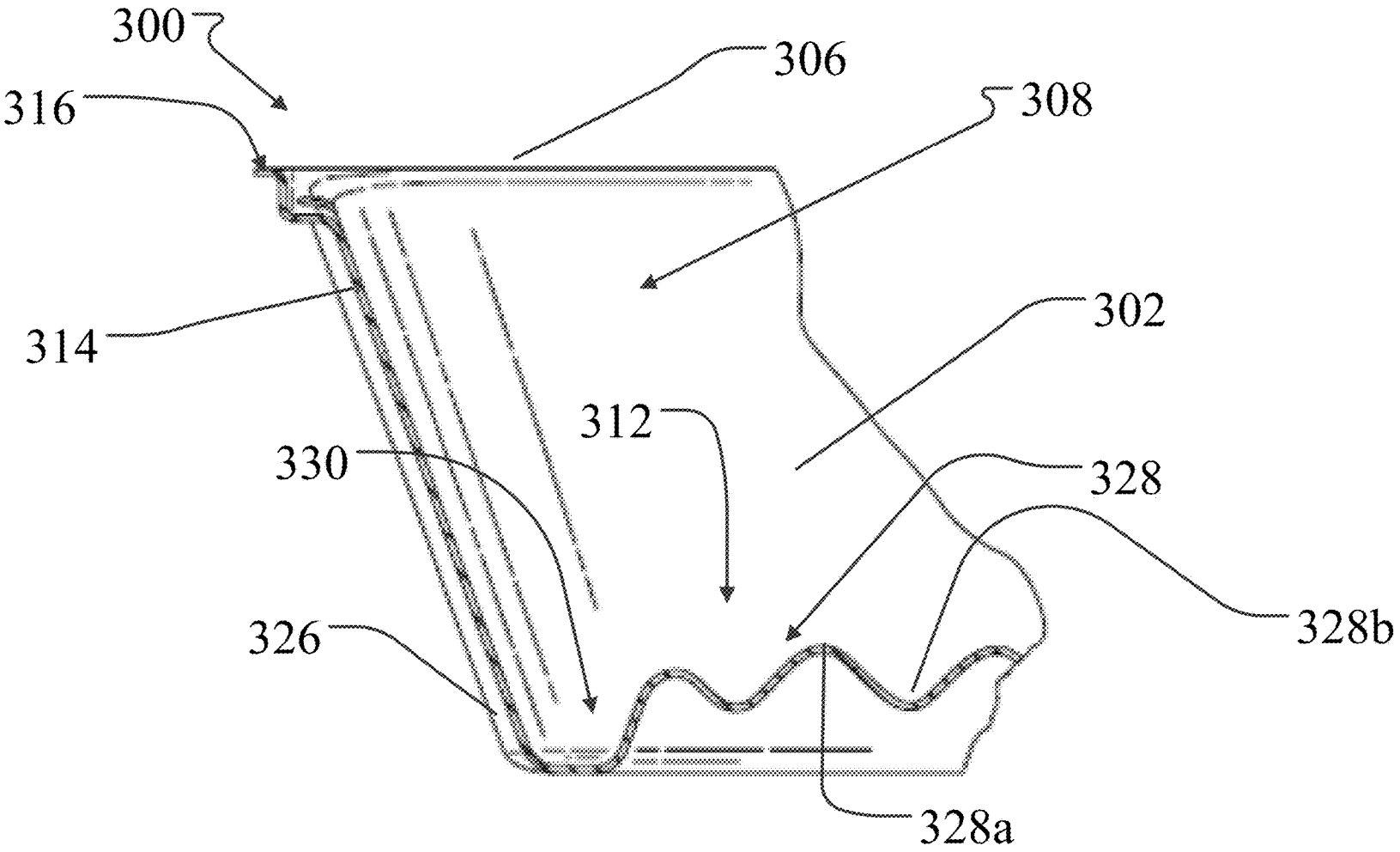
FIG. 5 is partial section view of a tray portion of the molded fiber container of FIG. 4A.

FIG. 5 is partial section view of a tray portion of the molded fiber container 300 of FIG. 4A. A number of features depicted in FIG. 5 are described in the context of FIGS. 4A and 4B and, as such, are not necessarily described further. FIG. 5 more clearly depicts the bottom surface 312, namely the sawtooth 328 configuration thereof. This sawtooth 328 configuration is applicable to the container 300 of FIGS. 4A and 4B, as well as the containers 100 and 200 of FIGS. 1A-1B and 2, respectively. Both the peaks 328*a* and valleys 328*b* of the sawtooth 328 are disposed higher than the lowermost surface of the moat 330. Again, this allows the foodstuff disposed in the container 300 to be elevated above the material that forms the bottom surface 312. Additionally, the level of the moat 330 below the sawtooth 328 allows condensation, sauces, etc., to drain away from the food.

Figure 6:
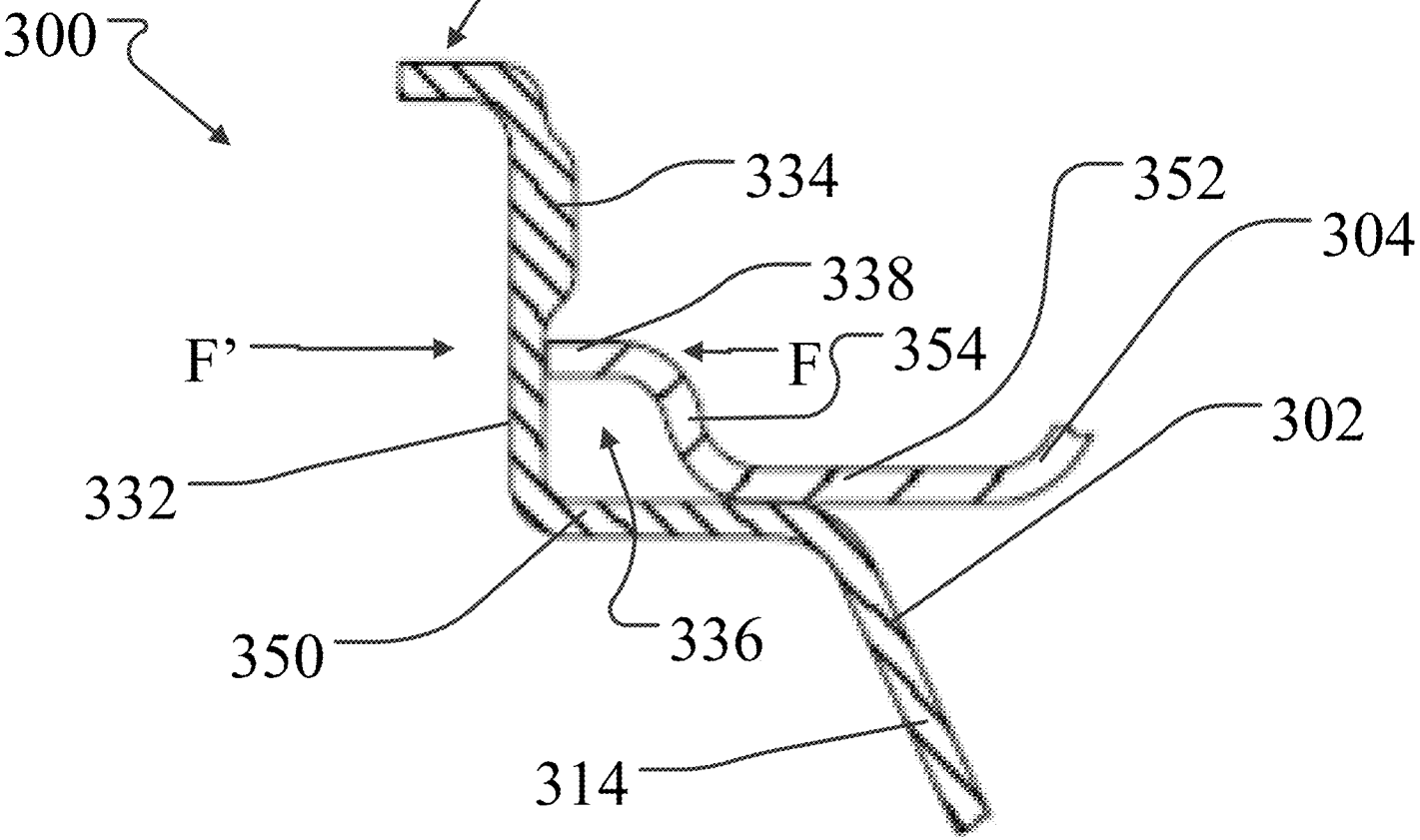
FIG. 6 is a partial section view of the tray and lid portions of the molded fiber container of FIG. 4B, depicting a locking interface therebetween.

FIG. 6 is a partial section view of the tray 302 and lid 304 portions of the molded fiber container 300 of FIG. 4B, depicting a locking interface therebetween. This condition occurs when the container 300 is in the closed configuration of FIG. 4B. A number of features depicted in FIG. 6 are described elsewhere herein and, as such, are not necessarily described further. Disposed above the perimeter wall 314 of the tray 302, the parapet 332 extends substantially vertically and includes a build-up extending away from the parapet 332 so as to define a gap 336. The lid 304 includes a rim 338 extending therefrom. The rim 338 fits within the gap 336, below the level of the build-up 334, so as to retain the rim 338 in place. Since the rim 338 is disposed substantially orthogonal to the parapet 332, an edge of the rim 338 presses against the parapet 332. Further, given the relative dimensions of the lid 304 and the tray 302 in this section, a pushing force F from the lid 304 is resisted by an opposite pushing force F' from the tray 302 (e.g., at the parapet 332). These opposed pushing forces help retain the rim 338 within the gap 336 and helps prevent the rim 338 from moving upwards against the build-up 334. Further, the tray 302 includes a rest 350 against which a mating lateral surface 352 of the lid 304 may rest. Extending upward from the lateral surface 352 is a rising surface 354 that connects the mating lateral surface to the rim 338. The rising surface 354 may act as a spring, forcing the rim 338 outwards against the parapet 332.

Figure 7:
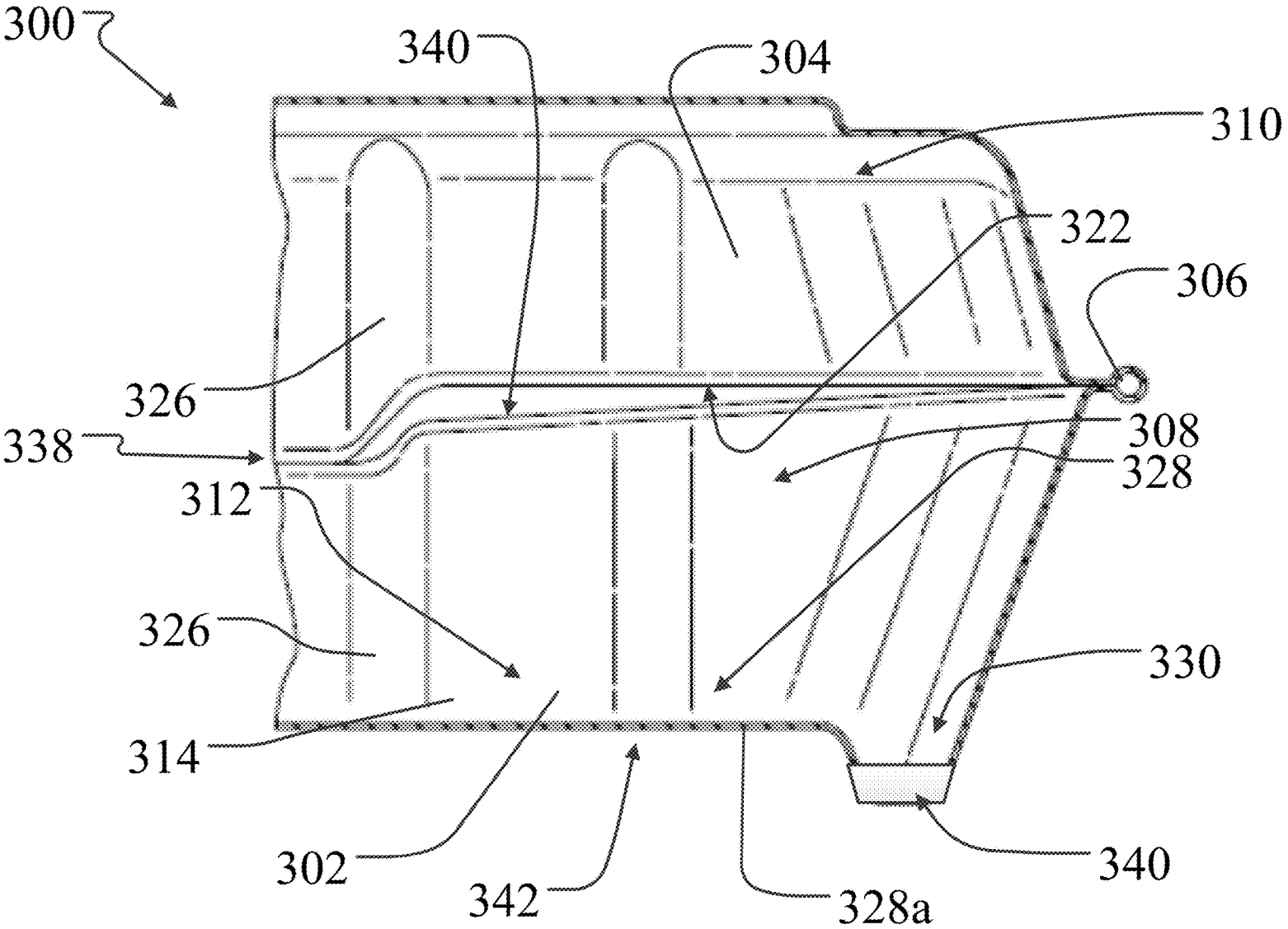
FIG. 7 is a partial section view of the tray and lid portions of the molded fiber container of FIG. 4B, depicting an interface therebetween.

FIG. 7 is a partial section view of the tray 302 and lid 204 portions of the molded fiber container 300 of FIG. 4B, depicting an interface therebetween. This condition occurs when the container 300 is in the closed condition of FIG. 4B. A number of features depicted in FIG. 7 are described elsewhere herein and, as such, are not necessarily described further. FIG. 7 depicts the connection of the tray 302 and lid 304 at the hinge 306. Engagement between surfaces of the tray 302 and lid 304 are also depicted. For example, at the locking interface 338, surfaces of the tray 302 and lid 304 may be tightly engaged, as described elsewhere. However, a separation is present between the ramp 340 of the tray 302 and the lower rim 322 of the lid 304, as depicted. FIG. 7 depicts an additional feature of the tray 302. Instead of a moat 330 encircling the entire perimeter of the tray 302, the moat may at least partially define one or more raised passages 340 that enable ambient airflow into and out of the void 342 disposed below the raised bottom surface 312. Airflow into this void 342 may further reduce the accumulation of moisture therein, helping to preserve the integrity of the material that forms the container 300.

In general, the depicted containers are four-sided elements defined a major axis and a minor axis. Opposing sides are parallel to a single axis. Further, while the term "sides" is used to describe the outer lateral limits of the container, the sides may further be defined by their location relative to a predetermined point of view. For example, the terms "front," "back," "right," and "left," may also be used to describe certain of the sides, in this case, the sides parallel to the major axis. The major and minor axes may also be used to describe the orientation of the various partitions, which may be straight, curved, at non-orthogonal angles to both the major and minor axes, etc. While the depicted containers include four sides, containers having other configurations of sides, such as five, six, or eight, are also contemplated. Containers having an equal number of sides are most likely to be utilized commercially. The terms "top" and "bottom" are used to describe, respectively, the upper and lower limits of the container. The terms "upward" and "downward," as well as "inward" and "outward" are relative terms used for the convenience of the reader. A person of skill in the art, upon reading this disclosure, will understand the context in which these terms are used.

As noted, the container body is formed from one or more unitary pieces of molded material, having a material thickness generally consistent along its entire exposed area, within manufacturing tolerances. In examples, the material may be molded to a material thickness of about 1.0 mm to about 1.3 mm. In examples, 1.15 mm has shown particularly desirable results and performance. Material thickness may be further modified based on the material (food) being held in the tray; that is, lighter food having a lower moisture content may not require as thick of a material as heavier food having a higher moisture content. Thus, material thicknesses of about 0.8 mm to about 1.5 mm and about 0.6 mm to about 1.7 mm are also contemplated. The materials utilized in the manufacture of the tray may be molded fiber, such as described in U.S. Pat. No. 10,036,126, entitled "Methods for Manufacturing Fiber-Based Beverage Lids," the disclosure of which is hereby incorporated by reference herein in its entirety.

The components, surfaces, and other features described herein may be measured relative to a Cartesian coordinate system as well known to persons of skill in the art. That is, a surface that is described as disposed an "a 30° angle to the x axis" would be understood to be disposed at an angle of 60° to they axis. Further, the terms "horizontal" and "vertical" may also be used to describe surfaces oriented in the x axis only and y axis only, as understood in the art. Unless otherwise specified, angular orientations of components, surfaces, and features describe the orientation of surfaces of the tray that engage with surfaces of the lid, since that engagement is relevant to the function of the locking interface. The inner tray and lid wall surfaces are disposed at an angle to they axis of about 5°, although angular ranges of about 0°, about 1°, about 2°, about 3°, about 4°, about 0° to about 10°, about 5° to about 15°, about 10° to about 20°, about 15° to about 25°, and about 20° to about 30° are also contemplated.

Any number of the features of the different examples described herein may be combined into one single example and alternate examples having fewer than or more than all of the features herein described are possible. It is to be understood that terminology employed herein is used for the purpose of describing particular examples only and is not intended to be limiting. It must be noted that, as used in this specification, the singular forms "a," "an," and "the" include plural referents unless the context clearly dictates otherwise.

While there have been described herein what are to be considered exemplary and preferred examples of the present technology, other modifications of the technology will become apparent to those skilled in the art from the teachings herein. The particular methods of manufacture and geometries disclosed herein are exemplary in nature and are not to be considered limiting. It is therefore desired to be secured in the appended claims all such modifications as fall within the spirit and scope of the technology. Accordingly, what is desired to be secured by Letters Patent is the technology as defined and differentiated in the following claims, and all equivalents.

What is claimed is:

1. A container comprising:

a molded fiber tray at least partially defining a tray internal volume, wherein the molded fiber tray comprises a perimeter wall extending upward from a bottom tray surface, a rest extending outward from the perimeter wall, a parapet extending upward from the rest, and a tray build-up projecting inward from the parapet, wherein the tray build-up and the rest at least partially define a gap therebetween; and a molded fiber lid at least partially defining a lid internal volume, wherein the molded fiber lid comprises a perimeter wall extending downward from a lid upper surface, and a ridge extending downward from the perimeter wall, wherein the ridge comprises an outer ridge wall, a lateral surface extending inward from the outer ridge wall, and a lid build-up projecting outward from the outer ridge wall, wherein the lid build-up is configured to be received in the gap when the container is in a closed condition, wherein each of the tray and the lid comprises a rim, wherein when the container is in the closed condition, (i) the tray build-up and the lid build-up are in contact around a perimeter of the container, (ii) the tray rim is in contact with the lid rim, and (iii) the tray rest is in contact with the lid lateral surface, and wherein the lid build-up comprises a lid build-up terminal surface and, when the container is in the closed condition, the lid build-up terminal surface presses outward against the parapet such that a pushing force from the lid build-up terminal surface is resisted by an opposite pushing force from the parapet to retain the lid build-up in the gap and prevent the lid build-up from moving upwards against the tray build-up.

2. The container of claim 1, further comprising a molded fiber hinge integrally formed with both the molded fiber tray and the molded fiber lid.

3. The container of claim 1, wherein the parapet comprises a first thickness and the tray build-up comprises a second thickness greater than the first thickness.

4. The container of claim 1, wherein a height of the tray build-up is greater than a thickness of the tray build-up.

5. The container of claim 1, wherein each of the tray build-up and the lid build-up comprise a leading surface and a holding surface.

6. The container of claim 5, wherein the tray build-up further comprises a tray build-up terminal surface spanning the tray build-up leading surface and the tray build-up holding surface.

7. The container of claim 6, wherein the lid build-up terminal surface spans the lid build-up leading surface and the lid build-up holding surface.

8. The container of claim 7, wherein when in the closed condition, the tray build-up terminal surface is in contact with the outer ridge wall.

9. The container of claim 5, wherein each of the tray build-up leading surface and the tray build-up holding surface are disposed at an angle to the parapet.

10. The container of claim 1, further comprising a molded fiber hinge integral with both the tray rim and the lid rim.

11. The container of claim 1, wherein at least one of the tray and the lid comprises an integrally-formed molded fiber tab.

12. The container of claim 1, wherein the bottom tray surface is defined by a plurality of peaks alternating with a plurality of valleys.

13. The container of claim 12, wherein the plurality of peaks and the plurality of valleys are surrounded by a perimeter moat.

14. The container of claim 3, wherein the outer ridge wall comprises a third thickness and the lid build-up comprises a fourth thickness greater than the third thickness.

15. The container of claim 1, wherein the contact between the tray build-up and the lid build-up, the contact between the tray rim and the lid rim, and the contact between the tray rest and lid lateral surface forms a seal that reduces or eliminates leakage of liquids out of the container.

16. The container of claim 1, wherein the contact between the tray build-up and the lid build-up, the contact between the tray rim and the lid rim, and the contact between the tray rest and lid lateral surface prevents the lid build-up from moving relative to the tray build-up.

* * * * *